US005379461A

United States Patent [19]

Wilmers

[11] Patent Number: 5,379,461

[45] Date of Patent: Jan. 10, 1995

[54] INTERACTIVE CLOTHING WITH INDICIA AND COVER PANEL

[76] Inventor: Rita B. Wilmers, 79 Commerce St., Staten Island, N.Y. 10314

[21] Appl. No.: 56,417

[22] Filed: May 3, 1993

[51] Int. Cl.[6] ..... A41D 1/00

[52] U.S. Cl. ..... 2/115; 2/246; 2/247; 40/586

[58] Field of Search ..... 2/69, 70, 115, 114, 2/912–916, 918, 246, 247, 250, 251, 252, 247, 243 R, 244; 40/329, 586, 329, 247

[56] References Cited

U.S. PATENT DOCUMENTS

| | | | |
|---|---|---|---|
| 2,527,258 | 10/1950 | Kahn | 2/115 |
| 2,647,261 | 8/1953 | Rassner | 40/586 |
| 3,537,108 | 11/1970 | Daniels | 2/252 |
| 4,277,848 | 7/1981 | Boehland | 2/115 |
| 4,296,498 | 10/1981 | Vinson | 2/115 |
| 4,710,981 | 12/1987 | Sanchez | 2/913 |
| 4,820,164 | 4/1989 | Kemper | 40/586 |
| 4,834,688 | 5/1989 | Jones | 2/115 |
| 4,924,613 | 5/1990 | Levin | 2/247 |
| 4,991,233 | 2/1991 | Hall | 2/115 |
| 4,999,848 | 3/1991 | Oney | 2/115 |
| 5,052,056 | 10/1991 | Braun | 2/246 |
| 5,086,516 | 2/1992 | Baxter et al. | 2/246 |
| 5,159,718 | 11/1992 | Moyer | 2/115 |

*Primary Examiner*—Clifford D. Crowder
*Assistant Examiner*—Amy B. Vanatta
*Attorney, Agent, or Firm*—Dilworth & Barrese

[57] ABSTRACT

An article of interactive clothing is provided including a display panel having a first display section and a second display section, with the first display section having first indicia displayed thereon and the second display section having second indicia displayed thereon. A cover panel is provided for covering the second display section and is movable between a first position wherein a pocket is defined to contain items for ready access and a second position wherein the second indicia is revealed.

14 Claims, 1 Drawing Sheet

INTERACTIVE CLOTHING WITH INDICIA AND COVER PANEL

BACKGROUND OF THE INVENTION

1. Field of the Invention

This invention relates to clothing and more particularly to an article of clothing having indicia imprinted thereon for communicating an interactive message to a person other than the wearer.

2. Description of the Related Art

In recent years, there has been a growing trend in the garment industry to provide wearing apparel with interactive messages associated therewith. An interactive message may serve as an advertisement for a particular product or as a slogan to project one's opinion to others. Garments having interactive messages are described, for example, in U.S. Pat. No. 4,710,981 to Sanchez; U.S. Pat. No. 4,991,233 to Hall; and U.S. Pat. No. 4,999,848 to Oney. Each of these garments have an interactive message provided thereon which is covered by a panel. The panel is constructed to be selectively moved so as to reveal the message provided thereunder. However, aside from covering the message, the cover panel described in each of the above-identified patents serves no other function.

It is therefore an object of the subject invention to provide a garment having means for covering an interactive message, which means also serve as a pocket for containing items.

SUMMARY OF THE INVENTION

The subject invention is directed to an article of interactive clothing comprising a display panel having a first display section and a second display section. The first display section has first indicia displayed thereon and the second display section has second indicia displayed there, m, with the second indicia bearing a relationship to the first indicia. The clothing further comprises a movable cover panel for covering the second display section. The cover panel has a peripheral edge including a first continuous edge portion which is permanently secured to the display panel and a second continuous edge portion which is releasably secured to the display panel of the clothing by separable fastening means.

In use, the cover panel is movable between a first position wherein the second continuous edge portion of the peripheral edge is releasably secured to the display panel to define a pocket to contain items for ready access and a second position wherein the second continuous edge portion of the peripheral edge is released from the display panel to reveal the second indicia. Preferably, third indicia is displayed on the first display section adjacent the cover panel for instructing a person other than the wearer to move the cover panel from the first position to the second position.

In a preferred embodiment of the subject invention, the article of clothing includes a substantially rectangular moveable cover panel for covering the second display section. The cover panel has opposed first and second vertical edges and opposed upper and lower horizontal edges and is permanently secured to the display panel at least along a portion of the first vertical edge and the lower horizontal edge thereof. The cover panel is releasably secured to the display panel along the second vertical edge and is movable between a first position wherein the second vertical edge is releasably secured to the display panel to define a pocket to contain items for ready access and a second position wherein the second vertical edge is released from the display panel to reveal the second indicia.

Further features of the interactive clothing of the subject invention will become more readily apparent from the following detailed description taken in conjunction with the drawings.

BRIEF DESCRIPTION OF THE DRAWINGS

In order that those skilled in the art to which this invention appertains may understand how to make and use the same, a detailed description of the construction thereof in accordance with a preferred embodiment of the subject invention will follow referring by numerals to the accompanying drawings wherein.

DETAILED DESCRIPTION OF THE PREFERRED EMBODIMENT

Figure 1:
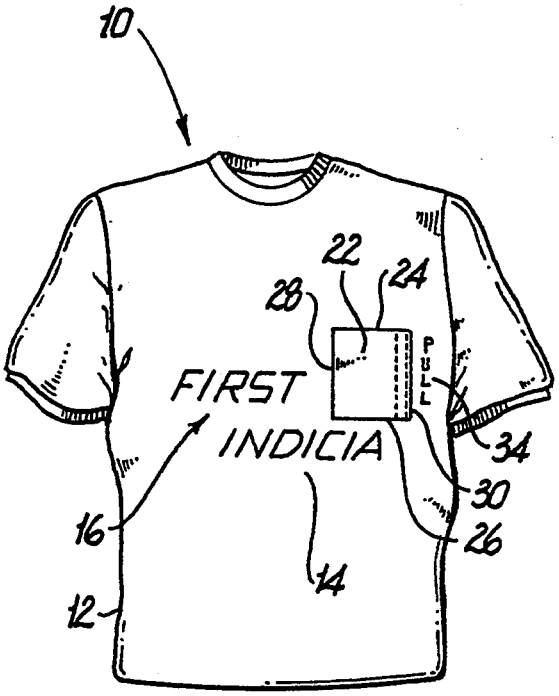
FIG. 1 is an elevational view of an article of interactive clothing in accordance with a preferred embodiment of the subject invention with the movable cover panel in a first position covering a portion of an interactive message.

Referring now in detail to the drawings wherein like reference numerals indicate similar structural elements of the invention, a unique article of interactive clothing is illustrated in FIG. 1 and is designated generally by reference numeral 10. For purposes of illustration, the article of clothing 10 of the subject invention will be described hereinbelow with respect to a short sleeve shirt. However, it is envisioned that other types of pocketed clothing may be provided in accordance with the subject invention. For example, the article of interactive clothing can be in the form of a dress, jump suit, pajamas, jacket, sweatshirt, romper, raincoat, night gown, shorts, or pants.

As shown in FIG. 1, the article of clothing 10 comprises a display panel 12 having a primary display area 14. First indicia 16 is displayed on the primary display area 14. Preferably, the first indicia 16 includes an illustration and a portion of a riddle which is related to the illustration. The illustration can be in the form of a cartoon representation of a person, place, or thing.

Figure 2:
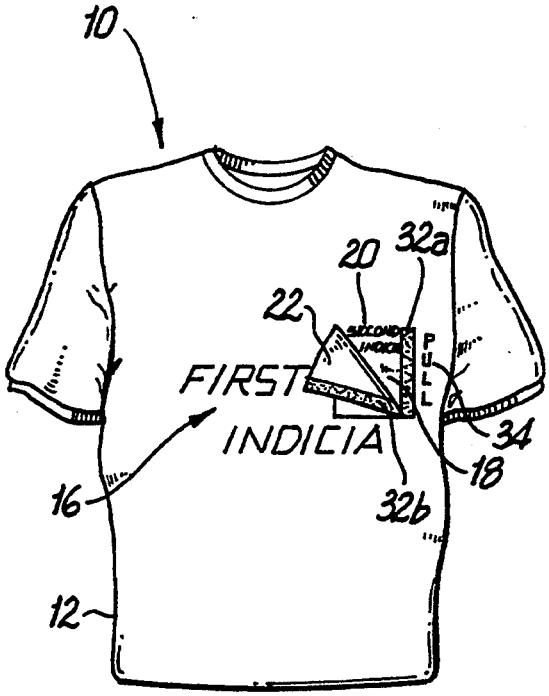
FIG. 2 is an elevational view of the article of interactive clothing of FIG. 1 with the movable cover panel in a second position revealing a portion of the interactive message.

Turning now to FIG. 2, the article of interactive clothing 10 further comprises a secondary display area 18. Second indicia 20 is displayed on the secondary display area 18 which is related to the first indicia 16. Preferably, the second indicia 20 sets forth an answer to the riddle disclosed by the first indicia 16.

A movable cover panel 22 having a substantially rectangular configuration is associated with the second display area 18 for concealing the second indicia 20 from an observer. Cover panel 22 includes opposed upper and lower horizontal edges 24 and 26, and opposed vertical edges 28 and 30. Preferably, at least a portion of vertical edge 28 and lower edge 26 are permanently secured to display panel 12 by stitching, heat fusing or other known fastening methods to define a continuous edge portion. The second vertical edge 30 is releasably secured to display panel 12 by a separable fastener of the hook and loop type, such as, for example, VELCRO® brand fastener marketed by Velcro Corporation, Manchester, New Hampshire. The separable fastener includes a first member 32*a* having a plurality of upstanding hook-like engaging elements and a second cooperating member 32*b* having a plurality of upstanding complimentary loop-type engaging elements. One skilled in the art to which the subject invention appertains will appreciate that other releasable fastening mechanism can be used such as, for example, a zipper or a zip-lock assembly, snaps, or buttons.

As best seen in FIG. 1, when the vertical edge 30 of cover panel 22 is releasably secured to display panel 12, cover panel 22 defines a pocket to contain items for ready access. In contrast, when the vertical edge 30 of cover panel 22 is released from display panel 12, the second indicia 20 is revealed to an observer. In a preferred embodiment of the subject invention, third indicia 34 is provided adjacent cover panel 22 to instruct a person other than the wearer to move the cover panel from the closed position of FIG. 1 to the open position of FIG. 2 to reveal the second indicia 20. There is no indicia displayed however, on cover panel 22 itself.

Figure 3:
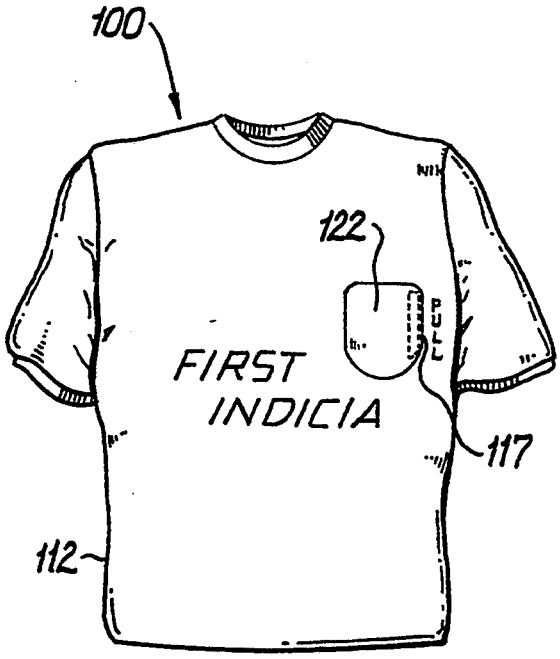
FIG. 3 is an elevational view of another article of interactive clothing in accordance with a preferred embodiment of the subject invention with the movable cover panel in a first position covering a portion of an interactive message.
Figure 4:
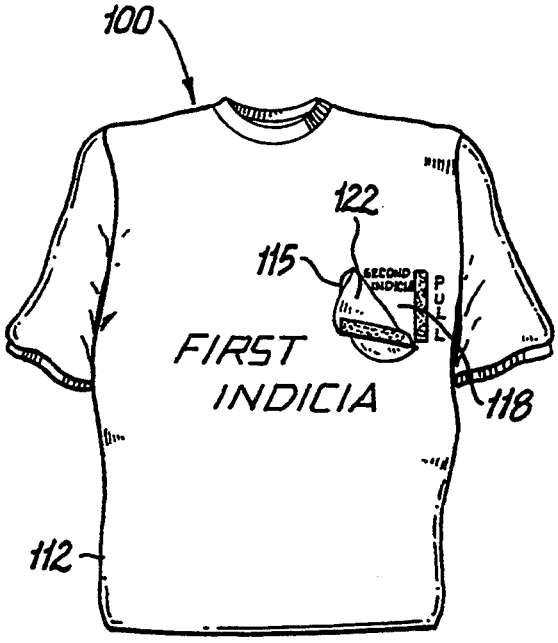
FIG. 4 is an elevational view of the article of interactive clothing of FIG. 3 with the movable cover panel in a second position revealing a portion of the interactive message.

Referring now to FIGS. 3 and 4, another article of interactive clothing in accordance with a preferred embodiment of the subject invention is illustrated and is designated generally by reference numeral 100. The article of clothing 100 is substantially similar to the article of clothing 10 with the exception of the configuration of the movable cover panel associated therewith. In particular, cover panel 122 is generally elliptical in configuration and is permanently secured to display panel 112 along a first continuous edge portion 115 of a suitable arc-length to permit the revelation of a major portion of the secondary display area 118. Another continuous arcuate edge portion 117 of the peripheral edge of cover panel 122 is releasably secured to display panel 112 by known fastening methods. As in the previous embodiment of the interactive clothing, cover panel 122 defines a pocket when the first arcuate edge portion 115 is releasably secured to display panel 112, as shown in FIG. 3, and is movable to an open position, as shown in FIG. 4, to reveal the second indicia 120.

While the interactive clothing of the subject invention has been described with respect to a preferred embodiment, it is apparent that changes or modifications may be made thereto without departing from the spirit or scope of the invention as defined by the appended claims.

What is claimed is:

1. An article of interactive clothing comprising:

a) a display panel having a first display section and a second display section, said first display section having first indicia displayed thereon, said second display section having second indicia displayed thereon, said second indicia bearing a relationship to said first indicia; and b) a movable cover panel covering said second display section and having a peripheral edge including:

i) a first continuous edge portion fixedly secured to said display panel;

ii) a second continuous edge portion having a length, said second edge portion being releasably secured to said display panel along the entire length thereof; and a third continuous edge portion having a length and extending between said first and second edge portions in a generally horizontal direction, said third continuous edge portion being free from securement to said display panel along the entire length thereof to define an opening, said cover panel being movable between a first position wherein said second continuous edge portion of said peripheral edge is releasably secured to said display panel to define a pocket to contain items for ready access through said opening and a second position wherein said second continuous edge portion of said peripheral edge is released from said display panel to reveal said second indicia.

2. An article of clothing as recited in claim 1, further comprising third indicia displayed on said first display section adjacent said cover panel for instructing the movement of said cover panel from said first position to said second position.

3. An article of clothing as recited in claim 1, further comprising fastening means for releasably securing said second continuous edge portion of said cover panel to said display panel.

4. An article of clothing as recited in claim 3, wherein said fastening means comprises a hook and loop type separable fastener.

5. An article of clothing as recited in claim 1, wherein said cover panel is substantially rectangular in configuration.

6. An article of clothing as recited in claim 1, wherein said cover panel is substantially elliptical in configuration.

7. An article of interactive clothing comprising:

a) a display panel having a first display section and a second display section, said first display section having first indicia displayed thereon, said second display section having second indicia displayed thereon, said second indicia beating a relationship to said first indicia; and b) a substantially rectangular moveable cover panel covering said second display section, said cover panel having opposed first and second vertical edges and opposed upper and lower horizontal edges, said cover panel fixedly secured to said display panel along an entire length of said first vertical edge and an entire length of said lower horizontal edge, said cover panel releasably secured to said display panel along an entire length of said second vertical edge, said upper horizontal edge being free from securement to said display panel along an entire length thereof to define an opening, said cover panel being movable between a first position wherein said second vertical edge is releasably secured to said display panel to define a pocket to contain items for ready access through said opening and a second position wherein said second vertical edge is released from said display panel to reveal said second indicia.

8. An article of clothing as recited in claim 7, further comprising third indicia displayed on said first display section adjacent said cover panel for instructing the movement of said cover panel from said first position to said second position.

9. An article of clothing as recited in claim 7, further comprising fastening means for releasably securing said second vertical edge of said cover panel to said display panel.

10. An article of clothing as recited in claim 9, wherein said fastening means comprises a hook and loop type separable fastener.

11. An article of interactive clothing comprising:

a) a display panel having a first display section and a second display section, said first display section having first indicia displayed thereon, said second display section having second indicia displayed thereon, said second indicia bearing a relationship to said first indicia; and b) a substantially elliptical moveable cover panel covering said second display section and having a peripheral edge, said peripheral edge having a first arcuate edge portion defining a first arc length, said first arcuate edge portion being fixedly secured to said display panel along the entire arc length thereof, a second arcuate edge portion defining a second arc length, said second arcuate edge portion being releasably secured to said display panel along the entire arc length thereof, and a third arcuate edge portion having an arc length and extending between said first and second edge portions, said third arcuate edge portion being free from securement to said display panel along the entire are length thereof to define an opening, said cover panel being movable between a first position wherein said second arcuate edge portion is releasably secured to said display panel to define a pocket to contain items for ready access through said opening and a second position wherein said second arcuate edge portion is released from said display panel to reveal said second indicia.

12. An article of clothing as recited in claim 11, further comprising third indicia displayed on said first display section adjacent said cover panel for instructing the movement of said cover panel from said first position to said second position.

13. An article of clothing as recited in claim 11, further comprising fastening means for releasably securing said second arcuate edge portion of said cover panel to said display panel.

14. An article of clothing as recited in claim 13, wherein said fastening means comprises a hook and loop type separable fastener.

* * * * *